United States Patent [19]

Schoenrock et al.

[11] 3,982,956

[45] Sept. 28, 1976

[54] PROCESS FOR THE PURIFICATION OF IMPURE SUGAR JUICE

[75] Inventors: Karlheinz W. R. Schoenrock; Avinash Gupta; Hugh G. Rounds, all of Ogden, Utah

[73] Assignee: The Amalgamated Sugar Company, Ogden, Utah

[22] Filed: Sept. 26, 1975

[21] Appl. No.: 617,079

[52] U.S. Cl. ..... 127/46 A; 127/52; 210/30 R

[51] Int. Cl.[2] ..... C13D 3/14

[58] Field of Search ..... 127/46 R, 46 A, 46 B

[56] References Cited

UNITED STATES PATENTS

| | | | |
|---|---|---|---|
| 2,481,768 | 9/1949 | Mills | 127/46 A |
| 2,482,765 | 9/1949 | Haagensen | 127/46 A |
| 3,887,391 | 6/1975 | Schoenrock | 127/46 A |

*Primary Examiner*—Morris O. Wolk
*Assistant Examiner*—Sidney Marantz
*Attorney, Agent, or Firm*—Pierce, Scheffler & Parker

[57] ABSTRACT

Impure sugar solution having a pH of 2 – 6.5 is decolorized by passing the same through a weakly basic anion exchanger having tertiary amine functionality and operated over a hydroxyl form.

3 Claims, 1 Drawing Figure

WEAK ACID - WEAK BASE ION EXCHANGE SYSTEM FLOW DIAGRAM

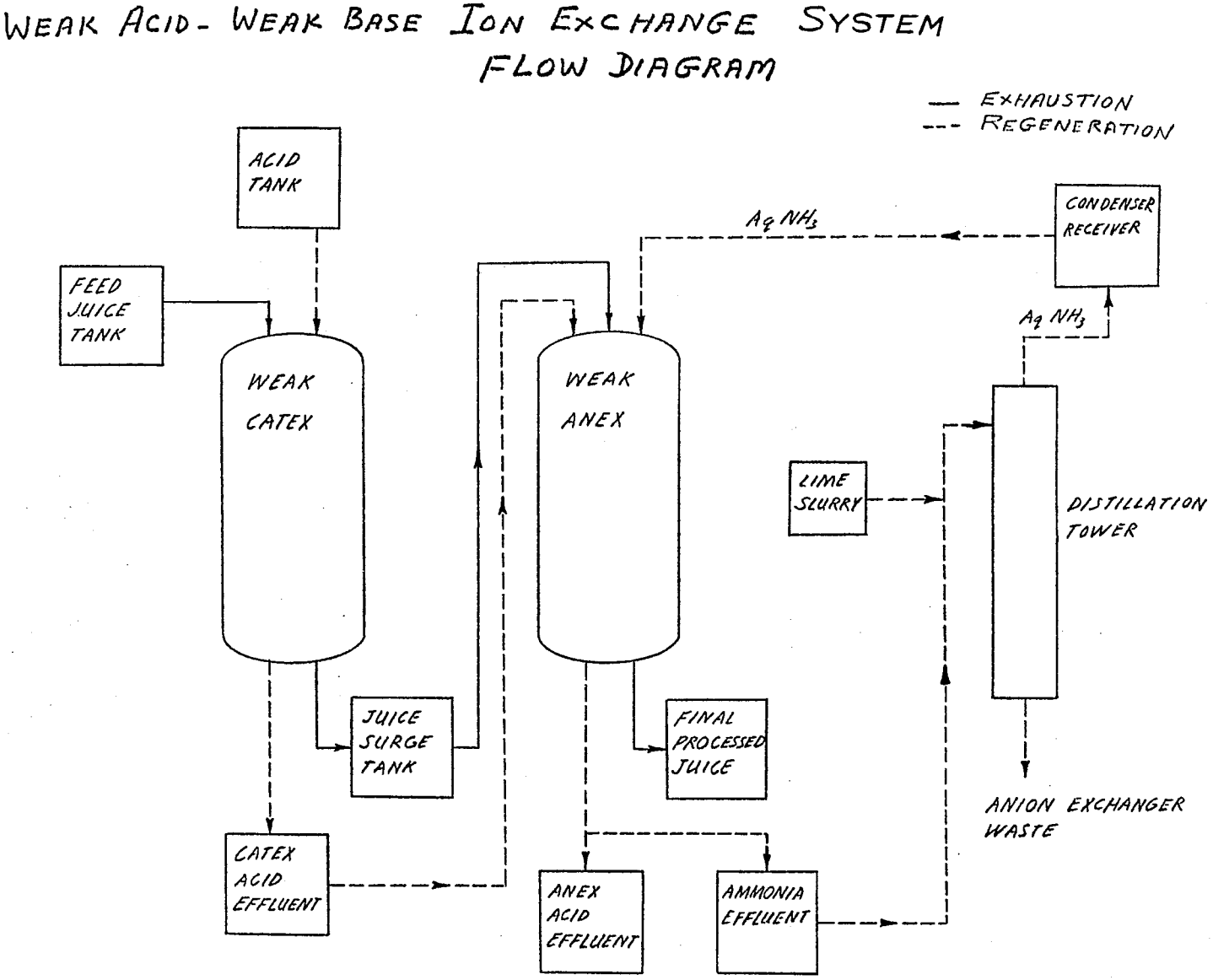
WEAK ACID - WEAK BASE ION EXCHANGE SYSTEM
FLOW DIAGRAM
— EXHAUSTION
--- REGENERATION
CONDENSER RECEIVER
Aq NH3
DISTILLATION TOWER
ANION EXCHANGER WASTE
LIME SLURRY
Aq NH3
FINAL PROCESSED JUICE
AMMONIA EFFLUENT
WEAK ANEX
ANEX ACID EFFLUENT
JUICE SURGE TANK
ACID TANK
WEAK CATEX
CATEX ACID EFFLUENT
FEED JUICE TANK

PROCESS FOR THE PURIFICATION OF IMPURE SUGAR JUICE

Certain impurities in impure sugar juice, especially such juice as originates with the sugarbeet, are particularly noxious in their interference with refining techniques applied to yield crystalline sucrose. Prominent among these noxious impurities which lower the quality of the final granulated sugar product are color bodies and so-called floc components. Refineries have found it necessary to resort to measures such as crystallizing at an elevated pH to inhibit the precipitation of floc (saponins) with the crystallization of the sugar, and to recrystallize the sugar extensively to control color carryover into the final product. Both steps lead to a reduction of efficiency and extraction. Decolorization by charcoal, activated carbon, or ion exchange is practiced to eliminate the noxious impurities and to increase refining techniques which are costly to install and to operate.

The decolorization of impure sugar juice via ion exchange is conventionally practiced with strongly basic anion exchanger having quarternary amine functionality. Such ion exchangers are conventionally regenerated with caustic soda or sodium chloride salt, the latter salt cycle being the preferred technique. The hydroxide cycle for a strongly basic anion exchanger having quarternary amine functionality is normally not employed because of its tendency to foul and to reduce its operating capacity over a short period of operating exposure. Operation by way of the salt cycle likewise leads to progressively increasing fouling and requires a large excess of salt for adequate regeneration of the decolorizer. Regeneration of a decolorizer with salt also causes reintroduction of another undesirable impurity, namely, chloride ions into the juice in exchange for the more noxious floc and color components.

Weadkly basic anion exchangers possessing tertiary amine functionality have inherently much better stability toward fouling and can be easily regenerated with nearly stoichiometric quantities of a weak base such as ammonium hydroxide. However, because of the weak ionization of impurities in sugar juices, a weakly basic anion exchanger is incapable of attracting such impurities from a highly buffered system.

In U.S. Pat. No. 3,887,391, Schoenrock, Richey and Rounds, there is disclosed a process for decalcifying sugar beet juice according to which undesirable cations are removed from sugar juice which has undergone a two-stage carbonation by treating the same with the hydrogen form of a carboxylic type cation exchanger, in a column, at a flowrate of 20–200 resin bedvolumes per hour, at an elevated temperature short of boiling, for a contact time less than 3 minutes, and thereafter realkalizing with magnesium oxide and filtering.

We have now discovered a process which is particularly suited to operate in conjunction with the process disclosed in U.S. Pat. No. 3,887,391 and which utilizes a weakly basic anion exchanger. Operated over the hydroxyl form under the aforementioned condition, — that is, with liquids having slight acidity, — the weakly basic anion exchangers have the ability to remove the major portion of the floc and color components, respectively, together with a significant amount of the total impurity load.

Only a small portion of the total cation load in impure sugar solutions is removed from such solutions in exchange for hydrogen when exposed to the conditions as outlined in U.S. Pat. No. 3,887,391. Indeed, the exchange is primarily limited to divalent cations.

We have now found that when such impure sugar solutions are first treated according to U.S. Pat. No. 3,887,391, they may be passed, immediately after the cation exchange and without an MgO addition, over the hydroxyl form of a weakly basic anion exchanger for the removal of the major portion of the floc and color impurities together with the removal of a small but significant amount of the combined impurities from such impure sugar solutions. The so-treated sugar solution is immediately suitable for concentration followed by crystallization of sucrose from such syrup. We have discovered, furthermore, that the acidic regenerant waste from the cation regeneration according to U.S. Pat. No. 3,887,391 can be effectively used to strip such impurities as originated through the treatment of such weakly basic anion exchanger with impure sugar solutions from weakly basic anion exchanger. This stripping action upon the weakly basic anion exchanger results in:

a. the elimination of a gradual build-up of noxious foulants on the exchanger which commonly leads to a premature loss of exchanger functionality;
b. significantly reduces requirements for aqua ammonia in the conversion of the weakly basic anion exchanger to the hydroxyl form;
c. substantially reduces the waste disposal problem normally associated with ion exchange operations; and
d. simplifies the recovery of ammonia from the regeneration waste of the weakly basic exchanger and its reuse for the regeneration of the same.

Additionally, we have discovered that a mixture of sodium chloride solution and ammonium hydroxide solution at all practical ratios is a more effective regenerant that is straight ammonium hydroxide for converting a weakly basic anion exchanger to the hydroxyl form after the exchanger has become exhausted with impure sugar solution which has first been treated by a weakly acidic cation exchanger in the hydrogen form.

The new process of the present invention takes the place of equation VII, page 2, line 27 of U.S. Pat. No. 3,887,391; hence, it eliminates the MgO addition with the described new ion exchange process.

The first function of the new process is the same as that achieved in U.S. Pat. No. 3,887,391 with MgO addition, namely, to remove acidity. The new process achieves that function by adding $OH^-$ which reacts with $H^+$ to form water. Hence, no additional impurity is added.

The second function of the present process comes about through the exchange of free acids (saponins, color, general impurities) for $OH^-$. This function removes noxious non-sugars, hence, bringing benefits in increased extraction, improved product quality and reduced equipment loading or increased operating capacity of a plant.

Another integration with U.S. Pat. No. 3,887,391 is brought about through the use of the acidic regenerant waste from the "catex" process as detailed on page 2, lines 30–33; page 3, lines 25–28 and lines 43–45 of U.S. Pat. No. 3,887,391.

In the following, an example shall demonstrate the application of our invention. This particular example is not to be construed that the application of our invention be limited to the treatment of impure sugarbeet juice, but this invention may be used with sugarcane juice, water treatment, or any application where a liquid was first treated via a weakly acidic cation exchanger under the condition as outlined in U.S. Pat. No. 3,887,391, or where an acidic condition with pH values between 2–6.5 exists.

EXAMPLE 125 liters of a sugarbeet juice composite having been treated as disclosed in U.S. Pat. No. 3,887,391 by a weak cation exchanger ("CATEX") only, specifically, "Amberlite IRC84", which resulted in a composite pH of about 5.5 and containing about 15% dissolved solids at a purity of 89% with 2800 ICUMSA color units[1] and 70 ppm floc[2] were passed at a temperature not exceeding 50° C. through a column consisting of 1 liter weakly basic anion exchanger ("ANEX") having tertiary amine functionality, especially, "Amberlite IRA-68", in the hydroxyl form at a flowrate of 20 exchanger volumes per hour.

The collected so-treated juice composite had a pH of 8.9 at 20° C., a purity of 89.55%, an ICUMSA color of 1260, and 10.5 ppm floc amounting to a non-sugar removal of 5%; a color removal of 55%; and a floc removal of 85%. It was immediately suitable for concentration followed by crystallization of sucrose from such syrup.

After this exhaustion, the ANEX exchanger was rinsed free of sugar with about 1.5 liters of water at a flowrate of 3 liters per hour followed by 3 liters of the acidic cation exchanger regeneration waste derived as described in U.S. Pat. No. 3,887,391, at a flowrate of 3 liters per hour at temperatures below 60° C.; followed by a water rinse of 0.5 liter and at a flowrate of 3 liters per hour; followed by 1.2 liters of a 2 normal ammonium hydroxide solution flowing at a rate of 2 liters per hour. The anion exchanger was rinsed nearly free of ammonia with 0.5 liter of water and then could be returned for the treatment of weak-cation-exchanger-treated, slightly acidic, sugar juice.

The regeneration and regeneration rinse fractions containing the ammonium ions were collected together, treated with 60 grams of burned lime, and heated in a retort to drive off all free ammonia. The ammonia vapors were collected and condensed together with water to prepare a 7% ammonium hydroxide solution which was returned to the process for the regeneration of the exhausted and stripped anion exchanger. Recovery of ammonia was about 95% on the ammonia applied.

The attached schematic flow diagram illustrates the respective relationships of the processing steps involved.

It is to be noted that the principles of the process of the present application are applicable at very high acidity, say, below pH 1.0, thereby losing some of its specificity towards the noxious non-sugars as well as requiring far more rigorous prior treatment by strong catex, etc. The use of a weak anex as a follow-up of strong $H^+$ catex treatment for the generation of very low pH juices is a common process and requires elaborate provisions to prevent sugar inversion (operation at low temperature) and waste disposal. The present process avoids this by treating only slightly acidic CONditions such as are generated with the weak catex process U.S. Pat. No. 3,887,391) thereby achieving desirable conditions as outlined above.

We claim:

1. Process which comprises the steps of treating sugarbeet juice, after second carbonation, with the hydrogen form of a resinous carboxylic-type cation exchanger arranged in a column for the reduction of calcium ion in the juice, and thereupon passing the so-treated juice through a mass of particles of a weakly basic anion exchanger having a tertiary amine functionality and operated over the hydroxyl form.

2. The process defined in claim 1 wherein the weakly basic anion exchanger being exhausted with the sugar juice is first stripped with the acidic waste regeneration solution from the carboxylic type cation exchanger prior to the conversion of the weakly basic anion exchanger to its respective hydroxyl form via regeneration with aqueous ammonia.

3. The process defined in claim 2 wherein ammonia used for the regeneration of the weakly basic anion exchanger is recovered for reuse by treating the waste solution from said weakly basic anion exchanger with lime representing a nearly stoichiometric quantity on the amount of ammonium ions present in the weakly basic anion exchange waste solution; and distilling, collecting, and condensing the ammonia vapors to form ammonium hydroxide for reuse in the regeneration procedure.

* * * * *